US005485649A

United States Patent [19]

Miceli

[11] Patent Number: 5,485,649

[45] Date of Patent: Jan. 23, 1996

[54] BEACH BRUSH

[76] Inventor: Gary L. Miceli, 39 Scout La., Hummelstown, Pa. 17036

[21] Appl. No.: 494,307

[22] Filed: Mar. 16, 1990

[51] Int. Cl.[6] ..... A46B 7/00

[52] U.S. Cl. ..... 15/184; 15/169; 15/144.4

[58] Field of Search ..... 15/169, 184, 168, 15/172, 143.1, 144.1, 144.4, 145, 159.1, 160; D8/DIG. 7, 300–305; D4/135

[56] References Cited

U.S. PATENT DOCUMENTS

| | | | |
|---|---|---|---|
| D. 24,704 | 9/1895 | Dippo | D8/321 |
| D. 159,036 | 6/1950 | Baehr | D8/82 |
| D. 289,460 | 4/1987 | Exley et al. | D3/12 |
| 987,277 | 3/1911 | Wright | 15/169 |
| 2,984,852 | 5/1961 | George | 15/144 B |
| 3,205,523 | 9/1965 | Seaver | 15/169 |
| 4,691,404 | 9/1987 | Tarrson et al. | 15/184 |

FOREIGN PATENT DOCUMENTS

| | | | |
|---|---|---|---|
| 585589 | 3/1977 | Germany | 15/169 |

*Primary Examiner*—David A. Scherbel
*Assistant Examiner*—Patrick Brinson
*Attorney, Agent, or Firm*—John P. Halvonik

[57] ABSTRACT

The invention relates to a brush capable of brushing off sand and dirt from humans or animals and remain in a good, clean condition. The novelty resides in the use of an adjustable handle and cover that can vary the length of the bristles that are exposed. This in turn cause the bristles to change in flexibility so that the brush can be put to various uses that require differing degrees of stiffness of the brush.

22 Claims, 4 Drawing Sheets

BEACH BRUSH

BACKGROUND OF THE INVENTION

The present invention relates to the field of personal grooming products and specifically to brushes that are adapted to be used on human skin or animal fur, etc. for the purpose of removing sand, granular dirt, and other foreign substances that may accumulate there. Typically sand gets on the body at the beach while playing, swimming, relaxing, etc. Hair brushes can be used to remove the sand but typically they pickup the sand and can become dirty themselves. In addition they are cannot be adjusted for the bristle stiffness desired. It is desirable to have a brush that can be used specifically for removing sand and that can continue to have a clean appearance through repeated use.

PRIOR ART

While there are a number of brushes that are used for various purposes in the art there are none that applicant is aware of that utilize this method of adjusting the stiffness of the brush and that have this particular construction of the brush to facilitate this.

SUMMARY OF THE INVENTION

The brush of the present invention is adapted for removing sand, dirt or other foreign matter that cakes onto humans or animals, especially when they are on the beach. The brush comes with a moveable piece known as the cover that slides over the bristles of the brush so that the length of the bristles can be set longer or shorter to provide a looser or stiffer configuration depending on the application desired. The cover or handle is provided with a series of grooves that run parallel with the length of the brush. These grooves are designed to carry away the sand or dirt that would otherwise build up between the handle and cover of the brush. This build up would eventually bind the cover making it impossible to adjust the length of the bristles.

Figure 2D:
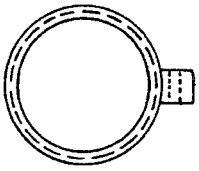
FIG. 2D. Cap.
Figure 2C:
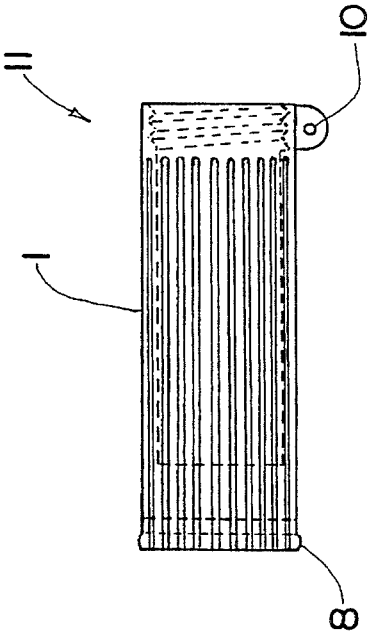
FIG. 2C. Handle and cover.
Figure 2A:
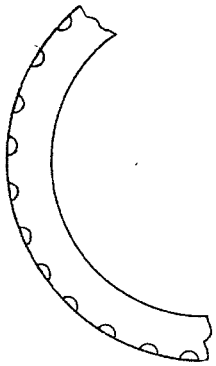
FIG. 2A. Detail of grooves.
Figure 2B:
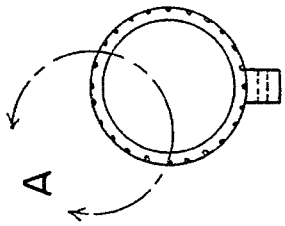
FIG. 2B. Cap showing direction of rotation.

The cover (5B) is a tube-like member that moves in telescoping relation to the bristles (6B) and the handle (2B), the cover can be made of plastic. The cover has been designed and assembled to interlock with the handle to assure a positive stop when fully extended, this is shown more fully by the stops shown at 8 and 10 of the handle in FIG. 2B, 2C, and 2D.

Figure 1A:
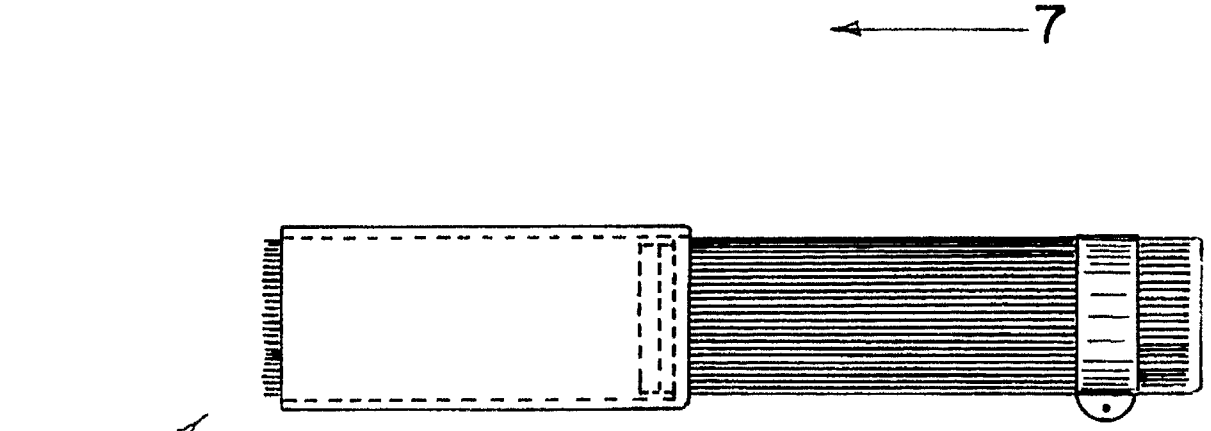
FIG. 1A. Cover in "fully closed" position.
Figure 1B:
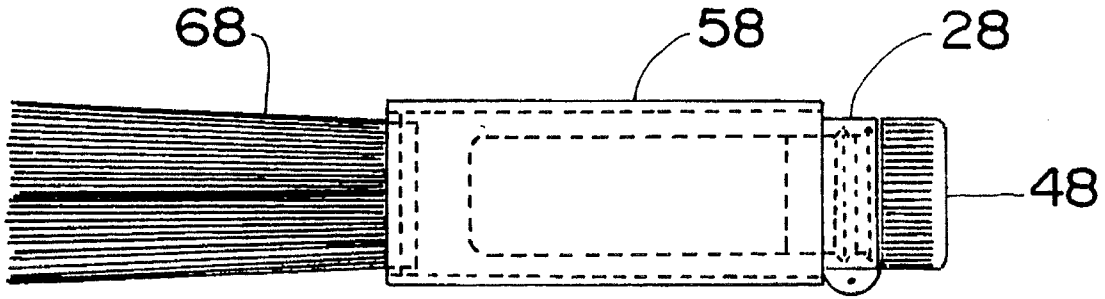
FIG. 1B. Cover in "fully retracted" position.
Figure 3A:
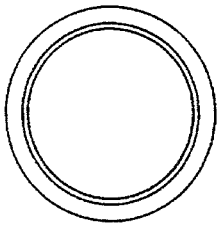
FIG. 3A. Front view of cover and inner stop.
Figure 3B:
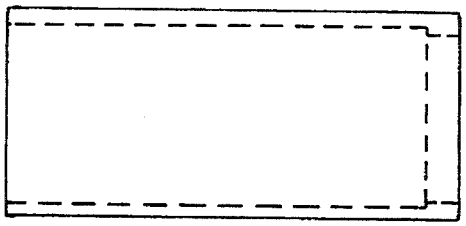
FIG. 3B. Side view of cover and inner stop.
Figure 4:
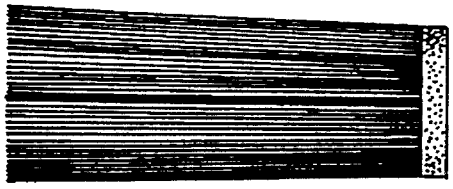
FIG. 4. Bristles.
Figure 5B:
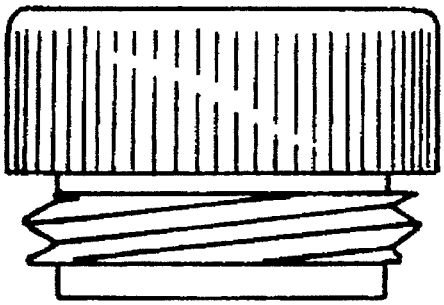
FIG. 5B. Cap showing threads.
Figure 5A:
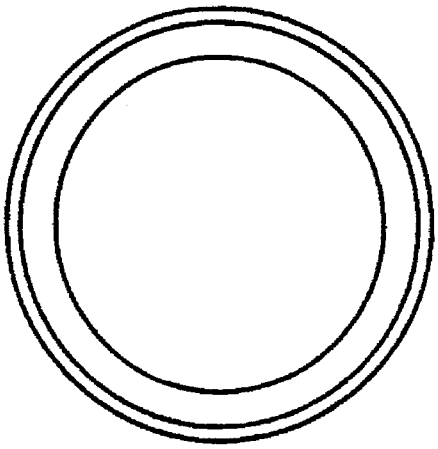
FIG. 5A. Front view of cap.

When the cover is moved toward the back end of the handle, see "fully exposed position" on FIG. 1B, more length of the bristles are exposed and thus they are able to move about more easily, thus they are more flexible. This is known as the "fully exposed" position. In contrast, as the cover is moved toward the front end of the handler more and more of the length of the bristles are held in place by the tube and they become more stiffer when the cover is moved as far forward as in can go, the maximum length of the bristles are covered by the cover and this position is known as the "fully closed" position, see FIG. 1A. Because the handle and cover are engineered to remain in a close fitting relationship, the cover can be set at various positions between the "fully closed" and "fully exposed" positions due to the frictional contact of the ridges on the handle, shown as 1 in FIG. 2C with the inner stop on the cover in FIG. 3A and B. This allows the firmness of the brush to be set by placing the cover in different positions along the handle and thus vary the amount of exposed length of bristle.

For example, the stiffer mode would find use on the coat of a dog or other animals. The stiffness of the bristles would aid in removing sand that gets matted deep within the coat. Alternately, when the brush is used on people, the bristles are set to a longer and thus, more flexible length so they will not cause a brush burn or be otherwise painful when sand is removed. The cover can be set at any one of a number of positions along the length of the handle so almost any desired length of bristle can be set.

Another advantage to the cover is that it can be extended most or all of the way over the bristles to protect them from getting dirty if the brush should happen to fall in the sand or dirt. This extension of the cover fully over the bristles can also help the bristles hold their shape when not in use. As a possible safety feature, the cover is built so that when it is at the "fully closed" position over the bristles a portion of the bristles remain uncovered by the cover 12. This is so that in the event that the brush is thrown or falls it might not hurt because the tips of the bristles will cushion the blow of the hard plastic handle, The bristles can be cleaned by hand when in the "fully exposed" positions.

On the inside of the cover, at the back end of the cover is a "stop," (see FIG. 3A and B) a piece of plastic or other material that encircles the inside rim of the cover and projects inwardly. This "stop" is designed to butt against a similar "stop" mounted at the front end of the handle that encircles the end of the handle and projects outwardly from it (shown as 8 in FIG. 2). This action prevents the cover from coming off the handle as it approaches the "fully closed" position. Of course the cover will not come off going the other way when approaching the "fully exposed" position, because it will butt against the outwardly projecting stop at the back end of the handle (shown as 10 in FIG. 2).

The handle is engineered so that the cover tends to remain in whatever position it is get at, from "fully exposed" to "fully closed". As shown in FIG. 2 the handle has a series of parallel grooves and corresponding ridges that run lengthwise along the handle, 1 in FIG. 2. The ridges 1 and the stop on the cover 9 are in a close fitting contact. This enables the cover to be set at various positions along the length and remain in place against minor forces. In addition, the height of the ridges may be varied so that the ridges gradually becomes higher proceeding toward the forward end of the of the handle (direction shown by arrow 7 in FIG. 1A). At the very forward end of the handle the thickness decreases, this permits the cover to be "locked" into position as it gets to the "fully closed" position. The cover is not absolutely locked in the "fully closed" position but it can remain in that position against relatively minor forces because the thickness of the handle resists the movement of the cover away from the "fully closed" position. The close fit of the handle and cover also permit the cover to remain in position when it is at positions intermediate those of "fully exposed" and "fully closed". In the "fully exposed" position the cover is at its loosest fit in relation to the handle. It tends to remain in this position because the ridges get higher in the forward direction and so applies a kind of frictional force against the cover moving forward.

The grooves are a special part of the brush. They serve to help carry away the dirt or sand particles that would other wise build up between the handle and the cover and cause the cover to bind and become immobile. To clean the area between the handle and the cover the cover member is moved back and forth along the handle while simultaneously twisting the cover or handle. This action carries the sand away by going through the channels in the handle and exiting from underneath the cover. The grooves could alternately be built into the cover, either method is possible as long as the grooves are of a shape and size that could carry away sand and other dirty matter from between the cover and the handle.

The handle can be made of hard plastic or ocher materials that would be available for the ordinary wear and tear that these brushes will see when in use. The cover member can be made of the same materials. The bristles are preferably made of polyester or nylon. The bristles may be flagged and tipped (looks like human hair split ends) on the exposed end. The unexposed bristle end is bonded and attached to the brush handle. The brush diameter is preferably 1 and ⅛ inches. Preferably, the cover and/or handle are textured to allow for a better grip.

The handle also provides a small storage compartment 48 in FIG. 1B that can be accessed by a threaded end cap to permit the storage of such valuables as keys, coins, jewelry etc. The handle also provides an eyelet for a carrying string and further provides a stop 10 for the cover when the brush becomes fully exposed. The end cap is made of plastic and can be machined or injection molded to its designed specifications. It provides a firm closure for the hollow interior of the handle. The circumference of the end cap has been grooved to allow an easy grip for opening and closing. The carrying string may be made of nylon and allows the Beach Brush to be carried conveniently around the waist.

I claim:

1. A brush for removal of dirty matter off of humans and animals comprising:

a) plurality of bristles, in substantially parallel relation to each other;

b) handle for supporting the ends of said bristles, said handle having an outer surface, a forward end where said bristles are supported, and a back end;

c) cover means of substantially smooth surface and located circumferentially around said handle and able to move back and forth over said handle so that said cover means may enclose varying lengths of said bristles, said cover means having a forward end and a back end;

d) grooves located substantially around the outer surface of said handle, said grooves parallel to each other and running from said forward end to said back end of said handle so that said grooves form a series of corresponding upraised parallel ridges in said handle, said ridges becoming gradually more upraised in the direction of said forward end of said handle, said ridges capable of fitting tightly against said cover so that said cover may be held in place at various positions along the length of said handle.

2. The apparatus of claim 1 wherein said handle has stop means for preventing said cover means from coming off said handle.

3. The apparatus of claim 2 wherein said handle has outwardly projecting stops near said forward and back ends of said handle, and said cover has a stop near said back end of said cover for preventing said cover means from coming off of said handle.

4. The apparatus of claim 2 wherein the grooves are about 1–40% of the thickness of said handle.

5. The apparatus of claim 4 wherein there are 5–200 grooves in the surface of the handle.

6. The apparatus of claim 5 wherein there are 24 grooves in the surface of said handle.

7. The apparatus of claim 2 wherein said cover is made of plastic.

8. The apparatus of claim 2 wherein said handle has an interior space and an end cap covering said interior space, said interior space capable of holding valuables.

9. The apparatus of claim 2 wherein said handle and said end cap are threaded.

10. The apparatus of claim 2 wherein said bristles are made of nylon.

11. The apparatus of claim 2 wherein the bristles are made of polyester.

12. A brush for removal of dirty matter off of humans and animals comprising:

a) plurality of bristles, in substantially parallel relation to each other;

b) handle for supporting the ends of said bristles, said handle having an outer surface, a forward end where said bristles are supported, and a back end;

c) cover means located circumferentially around said handle and having an inner surface adjacent to said handle, said cover means able to move back and forth over said handle so that said cover means may enclose varying lengths of said bristles, said cover means having a forward end and a back end;

d) grooves located substantially around the inner surface of said cover means, said grooves parallel to each other and running from said forward end to said back end of said cover means so that said grooves form a series of corresponding upraised parallel ridges in said cover means, said ridges becoming gradually more upraised in the direction of said forward end of said cover, said ridges capable of fitting tightly against said handle so that said cover may be held in place at various positions along the length of said handle.

13. The apparatus of claim 12 wherein said handle has stop means for preventing said dover means from coming off said handle.

14. The apparatus of claim 13 wherein said handle has outwardly projecting stops near said forward and back ends of said handle, and said cover has a stop near said back end of said cover means for preventing said cover means from coming off of said handle.

15. The apparatus of claim 13 wherein the grooves are about 1–40% of the thickness of said cover.

16. The apparatus of claim 15 wherein there are 5–200 grooves in the surface of the cover.

17. The apparatus of claim 16 wherein there are 24 grooves in the surface of said cover.

18. The apparatus of claim 13 wherein said cover is made of plastic.

19. The apparatus of claim 13 wherein said handle has an interior space and an end cap covering said interior space, said interior space capable of holding valuables.

20. The apparatus of claim 13 wherein said handle and said end cap are threaded.

21. The apparatus of claim 13 wherein said bristles are made of nylon.

22. The apparatus of claim 13 wherein the bristles are made of polyester.

* * * * *